United States Patent [19]

McKittrick, Jr. et al.

[11] Patent Number: 4,629,440

[45] Date of Patent: Dec. 16, 1986

[54] ANIMATED TOY

[75] Inventors: Michael T. McKittrick, Jr., Torrance; Nicholas DeAnda, Redondo Beach, both of Calif.

[73] Assignee: Mattel, Inc., Hawthorne, Calif.

[21] Appl. No.: 752,861

[22] Filed: Jul. 8, 1985

[51] Int. Cl.[4] ..... A63H 3/22

[52] U.S. Cl. ..... 446/356; 180/8.6

[58] Field of Search ..... 446/356, 355, 354, 353, 446/352, 293, 294, 292, 278, 156, 157, 158; 180/8.6, 8.3, 8.1, 8.5

[56] References Cited

U.S. PATENT DOCUMENTS

| | | | |
|---|---|---|---|
| 538,007 | 4/1895 | Adam | 446/356 |
| 912,108 | 2/1909 | Gaskill | 180/8.6 |
| 1,511,928 | 10/1924 | Zboril | 180/8.6 X |
| 1,782,477 | 11/1930 | Price | 446/356 |
| 1,986,446 | 1/1935 | Powleson | 446/355 |
| 2,329,564 | 9/1943 | Thomas | 446/158 |
| 2,366,576 | 1/1945 | Thomas | 446/353 |
| 2,827,735 | 3/1958 | Grimm, Jr. | 446/356 |
| 3,226,878 | 1/1966 | Glass et al. | 446/356 |
| 3,302,883 | 2/1967 | Stout | 180/8.6 X |
| 3,331,463 | 7/1967 | Kramer | 180/8.6 |
| 3,484,988 | 12/1969 | Robbins | 446/355 |
| 3,559,336 | 2/1971 | Nozaki | 446/356 |
| 4,216,612 | 8/1980 | Erickson et al. | 446/290 |
| 4,301,615 | 11/1981 | Ikeda | 446/293 |
| 4,372,078 | 2/1983 | Spring | 446/353 |

*Primary Examiner*—Mickey Yu

*Attorney, Agent, or Firm*—Ronald M. Goldman; Melvin A. Klein; John G. Mesaros

[57] ABSTRACT

An animated toy having a housing in the form of a body of a spider like insect with leg coupling members rotatably coupled thereto through ball and socket arrangements, with extensions thereof engaging cam follower members. The drive mechanism includes dual sided cam members with each cam having first and second cam portions for coaction with predetermined portions of the opening in a cam follower member to provide a modified "D" shape movement to the leg extensions, with the opposite cam portions on a given cam, and the position from cam to cam being mechanically phased to realistically simulate the walking movement of a spider like insect.

16 Claims, 6 Drawing Figures

38d
28a
38a
38d
28a 12
37
37b
37a
37c
47
51
44
34c
34a
14a
14b
34e
14c
34f
34b
14
60

ANIMATED TOY

BACKGROUND OF THE INVENTION

The background of the invention will be discussed in two parts:

1. Field of the Invention

This invention relates to animated toys, and more particularly to animated toys supported by appendages performing a walking motion.

2. Description of the Prior Art

Toys which move or have animated aspects have been a source of amusement for decades, particularly the types of toys in the form of vehicles, humans, animals or insects with some form of propulsion means.

One such early toy is shown and described in U.S. Pat. No. 538,007, issued Apr. 23, 1895, to Adam, for a "Mechanical Toy", in which a housing in the form of an insect or animal, is provided with spring-motor powered mechanically actuated appendages.

A mechanism for simulating walking movement is shown and described in U.S. Pat. No. 912,108, entitled "Mechanical Movement", issued to Gaskill, on Feb. 9, 1909, the mechanism including forked cranks for controlling movement of the pivot axes of the leg-like members along a path dictated by a cam member.

U.S. Pat. No. 1,511,928, entitled "Striding Motion Driving Gear for Motor Vehicles", was issued to Zboril, on Oct. 14, 1924, and illustrates a mechanism for performing a walking or striding motion, the mechanism being configured for replacement of the wheels on a motor vehicle, and constructed for enabling the rotary motion of the driving crank to be converted into a horizontal and practically uniform motion of the ends of the levers which form the feet.

U.S. Pat. No. 1,782,477, entitled "Animated Toy", issued to Price, on Nov. 25, 1930, such patent disclosing a housing in the form of an animal with four leg members pivotally connected thereto and operated by a spring-powered motor through a crank and linkages.

Another such animated toy is shown and described in U.S. Pat. No. 1,986,446, entitled "Walking Figure", issued to Powleson, on Jan. 1, 1935, the toy being in the form of a human having a pair of leg members with the upper portions thereof slotted and driven by eccentric members within the slots driven by a gear mechanism.

Another such animated toy is shown in U.S. Pat. No. 2,329,564, issued Sept. 14, 1943, to Thomas, for a "Toy Crocodile", the patent disclosing a toy intended for partial use in water with the head and tail thereof synchronized for movement with cam actuated leg drive means.

U.S. Pat. No. 2,366,576, issued to Thomas, on Jan. 2, 1945, entitled "Animated Figure", the figure being in the form of a giraffe with the rear legs fixed relative to the body and the front legs being articulated and cam-driven to propel the figure.

U.S. Pat. No. 2,827,735, entitled "Animated Toy", issued to Grimm, Jr., on Mar. 25, 1958, and discloses a insect-like toy having a plurality of inverted V-shaped legs, the inner ends of the legs being coupled to crank-driven reciprocating bar members for propelling the same.

A "Motor Driven Toy Bug" is shown and described in U.S. Pat. No. 3,226,878, issued to Glass et al, on Jan. 4, 1966. In this patent, the toy is configured to resemble the shape of a bug with three legs on each side connected in angular relation to common rotating hubs, with a mechanism provided for changing the speed of movement for a period of time in response to actuation of a lever.

Another animated toy is shown and described in U.S. Pat. No. 3,331,463, issued July 18, 1967, to Kramer, the patent being entitled "Motor Operated Ambulatory Vehicle", the vehicle being in the form of an insect with a plurality of leg members pivotally coupled and spring biased relative to the housing with cam followers on the inner ends of the legs. A pair of cam shafts coact with individual cam followers for manipulating the legs.

A "Walking Doll With Ambulatory Traction-Drive Mechanism" is shown and described in U.S. Pat. No. 3,484,988, issued Dec. 23, 1969 to Robbins, the doll including a drive mechanism in the lower part of the torso with a crank coacting with slots in the upper part of leg drive members with the foot portions each having a traction mechanism operating through an opening in the sole thereof.

U.S. Pat. No. 3,559,336, issued Feb. 2, 1971 to Nozaki for "Toy Having Capacitance Switch", discloses a figure toy in the form of an animated dog with switch means operating an electric motor to drive the toy, with the switch being operable in response to proximity of a human.

Another animated toy is shown and described in U.S. Pat. No. 4,216,612, issued Aug. 12, 1980 to Erickson et al, for "Toy Vehicle", the toy being wheel driven and having appendages spring coupled to the body portion for simulating movement on engaging the supporting surface and being released on overcoming of the friction of the surface.

Another such device is shown and decsribed in U.S. Pat. No. 4,301,615, issued Nov. 24, 1981 to Ikeda for "Toy Having First Member Capable of Going From a First Position to a Second Position and Automatically Returning to the First Position", the device being wheel driven and having the head portion thereof operable between an extended and a retracted position.

An animated device is shown and described in U.S. Pat. No. 4,372,078, issued Feb. 8, 1983, to Spring for "Toy Movable by Alternately Relocating Individual Members of a Pair of Body Parts", the toy being in the form of a pair of shoes coupled together with a crank mechanism actuated by a spring motor.

It is an object of the present invention to provide a new and improved animated toy.

It is another object of the present invention to provide a new and improved animated toy simulating a insect.

It is a further object of the present invention to provide a new and improved animated toy having removable appendages.

It is still another object of the present invention to provide a new and improved animated toy having appendages rotatably coupled to the body and operated by two-sided cam members.

It is a further object of the present invention to provide a new and improved motor operated animated toy in the form of an insect with a drive mechanism realistically simulating the walking motion of a six-legged insect.

SUMMARY OF THE INVENTION

The foregoing and other objects are accomplished by providing an animated toy having a housing in the form of a body of a insect with leg coupling members rotatably coupled thereto through ball and socket arrangements, with extensions thereof engaging cam follower members. The drive mechanism includes dual sided cam members with each cam having first and second cam portions for coaction with predetermined portions of the opening in a cam follower member to provide a modified "D" shape movement to the leg extensions, with the opposite cam portions on a given cam, and the position from cam to cam being mechanically phased to realistically simulate the walking movement of a spider-type insect.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
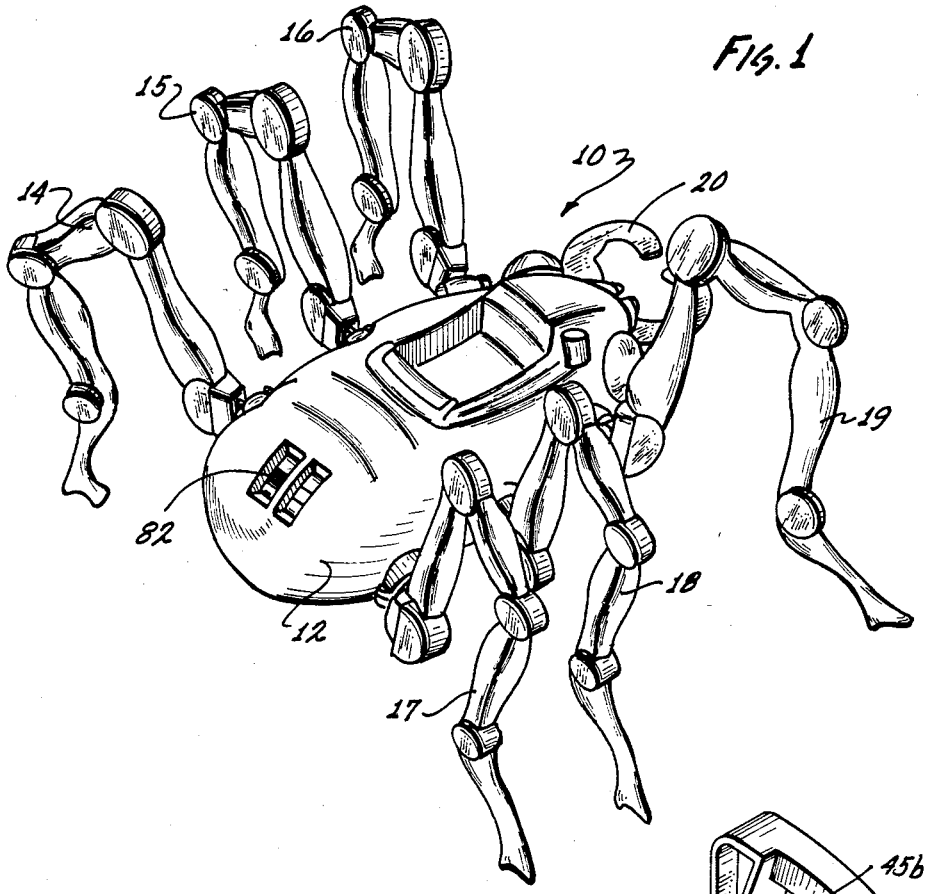
FIG. 1 is a perspective view of the animated toy in accordance with the present invention.

Referring now to the drawings, and particularly to FIG. 1, there is shown an animated toy, generally designated 10, in the form of an insect, having a main body 12, with one set of leg members 14–16 on one side thereof and a second set of leg members 17–19, on the other side thereof, the leg members 14–19 being coupled to said housing for movement relative thereto for propelling the toy 10 under the force of a drive mechanism within the body 12 thereof. As can be seen the leg members 14–19 are of an inverted generally U-shaped configuration to simulate the configuration of insect legs. At the head end of the toy 10, there is a pair of mandible members 20, which as will be hereafter described, are pivotably coupled to the body 10 and spring biased to enable retention of some other device therein, such as a figure toy (not shown).

Figure 2:
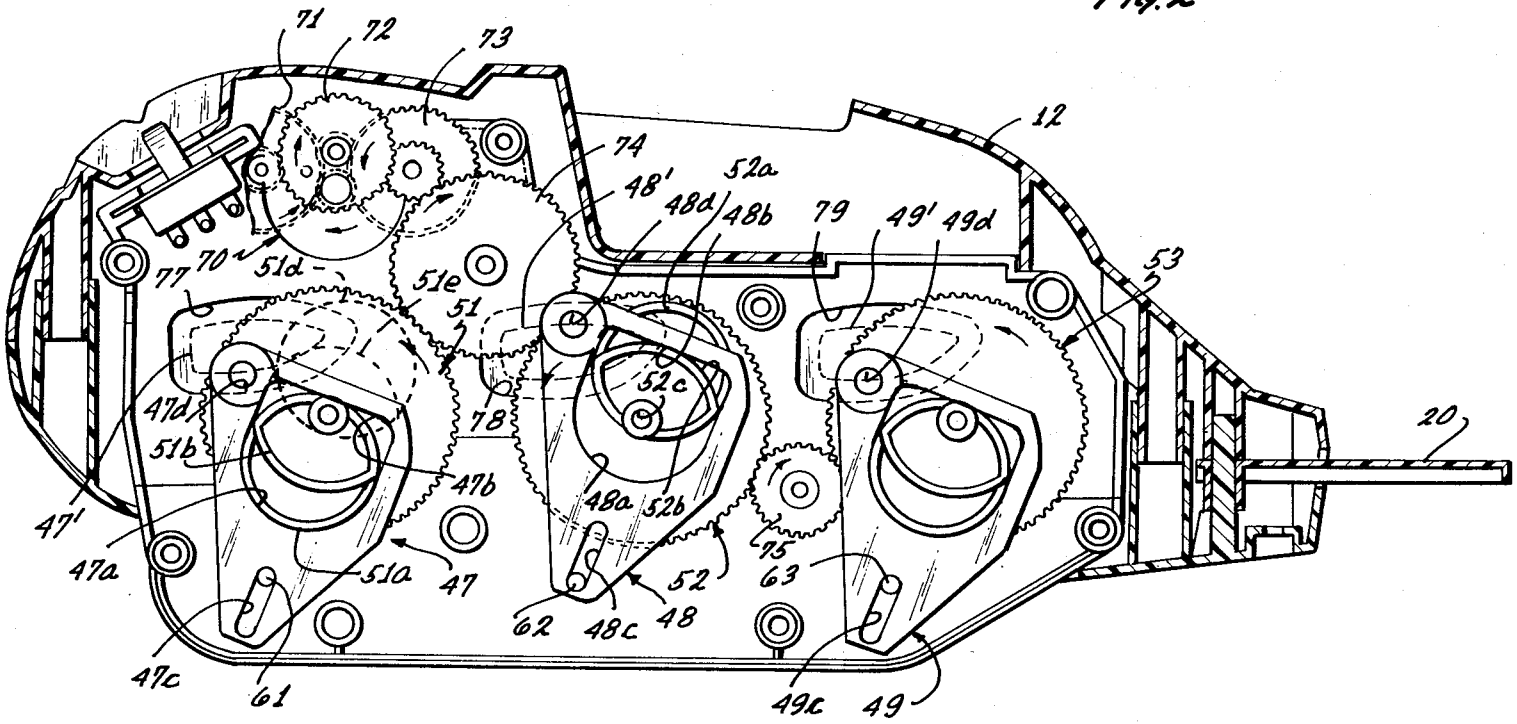
FIG. 2 is a side view, partially in cross-section of the body of the animated toy of FIG. 1 to illustrate the drive mechanism therein.
Figures 4, 6:
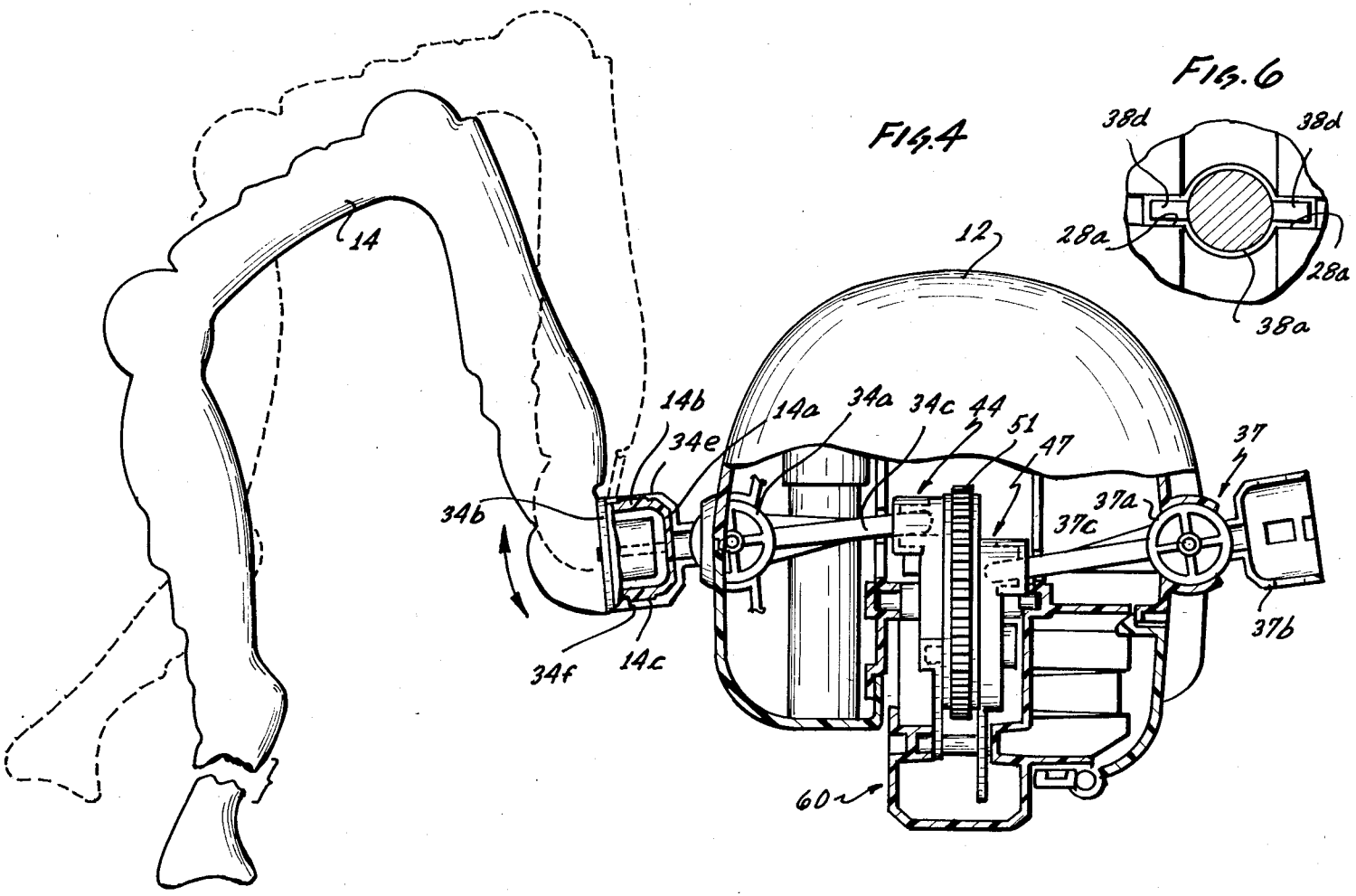
FIG. 4 is a rear view of the toy of FIG. 1, partially broken away and partially in cross-section to illustrate the coupling of the leg members to the drive mechanism of FIG. 2.
FIG. 6 is a cross-sectional view taken generally along line 6—6 of FIG. 5 illustrating the ball and socket connection of the leg coupling members.
Figure 5:
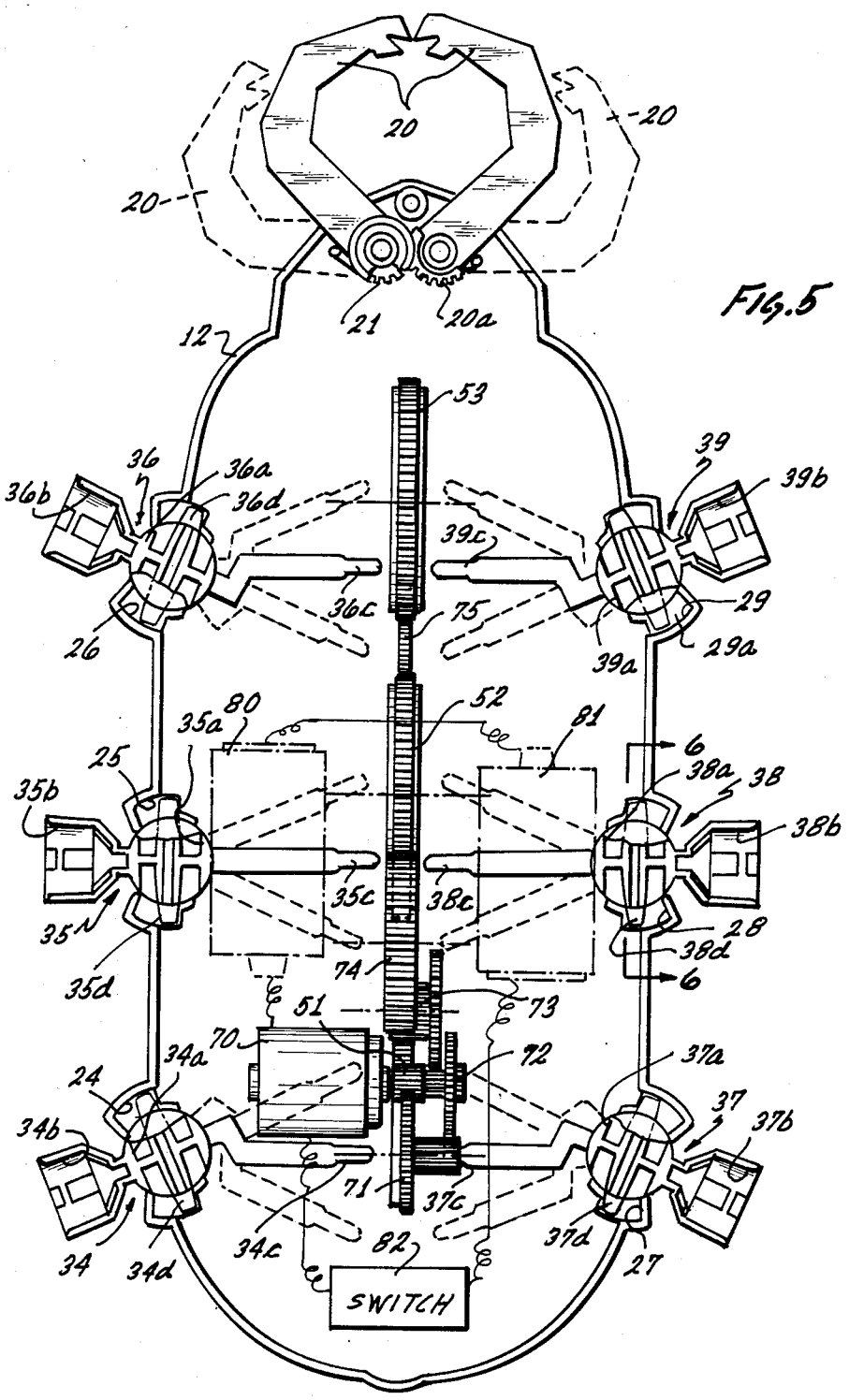
FIG. 5 is a top plan view of the animated toy of FIG. 1, partially broken away and partially in cross-section, with certain components omitted for clarity, to depict the electrical drive mechanism and the motion of the leg members.

Referring to FIGS. 2 through 5, the details pertaining to the drive mechanism and the interconnection of the leg members 14–19 therewith will now be described. As depicted in FIGS. 2, 4 and 5, the body 10 is a generally hollow housing with components assembled therein. As shown in FIG. 5, the outer surface of the body 12 is provided with a plurality of socket shaped openings 24–29, which engage ball-shaped portions **34*a*–39*a*, respectively, of leg coupling members 34–39, respectively. Each of the ball-shaped portions 34*a*–39*a* is provided with a diametrically extending integrally formed axle portion 34*d*–39*d*, with each of the socket openings 24–29 of the body 12 having a generally planar generally horizontal shoulder portion 28*a*, 29*a*, etc. (See FIGS. 5 and 6) about the periphery thereof on which this axle portion rests. In FIG. 5, the ball portion 39*a* of leg coupling member 39 has been cut away to show the horizontal shoulder 29*a* on which the axle projection 39*d* rides, while FIG. 6 is a cross-section through leg coupling member 38 showing the upper and lower shoulders 28*a* which effectively preclude the leg member 38** from twisting, thus maintaining the leg members generally perpendicular to the surface at all times.

By reference to FIG. 5, each of the axle projections pivots in a horizontal plane about an axis perpendicular to the plane of the drawing through an angle limited by the angular projections of the body 10 adjacent the opening 24–29 through which the leg coupling member 34–39 extends. Similarly, by reference to FIG. 4, the axle projections **34*d* and 37*d* establish a horizontal axis for pivoting of the leg coupling members 34 and 37 about the axis drawn perpendicular to the plane of the sheet through the center of the axle projections 34*d* and 37*d*, while enabling up and down motion of the leg coupling members 34 and 37. This two axis constraint configuration enables compound motion of the leg members while the outer ends of leg members 14 through 19 are in depending relation to the body 12 at all times for supporting the weight of the body 12 and for enabling operation of the toy 10**.

Each of the leg coupling members 34–39 includes the ball-shaped portion **34*a*–39*a*, respectively, an outwardly extending cup-shaped leg receiving portion 34*b*–39*b*, respectively, and an inwardly extending cam follower extension arm portion 34*c*–39*c*, respectively. As shown in FIG. 5, there are six such coupling members, arranged in oppositely disposed pairs with the forward and rearward pairs having the extension arms thereof offset and angularly disposed for coaction with the cam follower members 44–49 (See FIG. 2). Each of the leg receiving portions 34*b*–39*b* is provided with oppositely disposed upper and lower slots for interconnection with oppositely disposed mating tangs formed in the connecting ends of the leg members. This interconnection is exemplified in FIG. 4, wherein a leg member 14 has the connecting end 14*a* with tangs 14*b* and 14*c* engaging slots 34*e* and 34*f* respectively formed in the leg receiving portion 34*b*. For assembly, the leg member 14 is positioned in the dotted line position with the end 14*a* thereof in partial engagement within the leg receiving portion 34*b* of leg coupling member 34. The leg member 14 is then rotated downwardly with slight pressure toward the body 12, until the upper and lower tangs 14*b* and 14*c* are held captive by engagement with the slots 34*e* and 34*f*, thus retaining the leg member 14 within the leg coupling member 34**.

Figure 3:
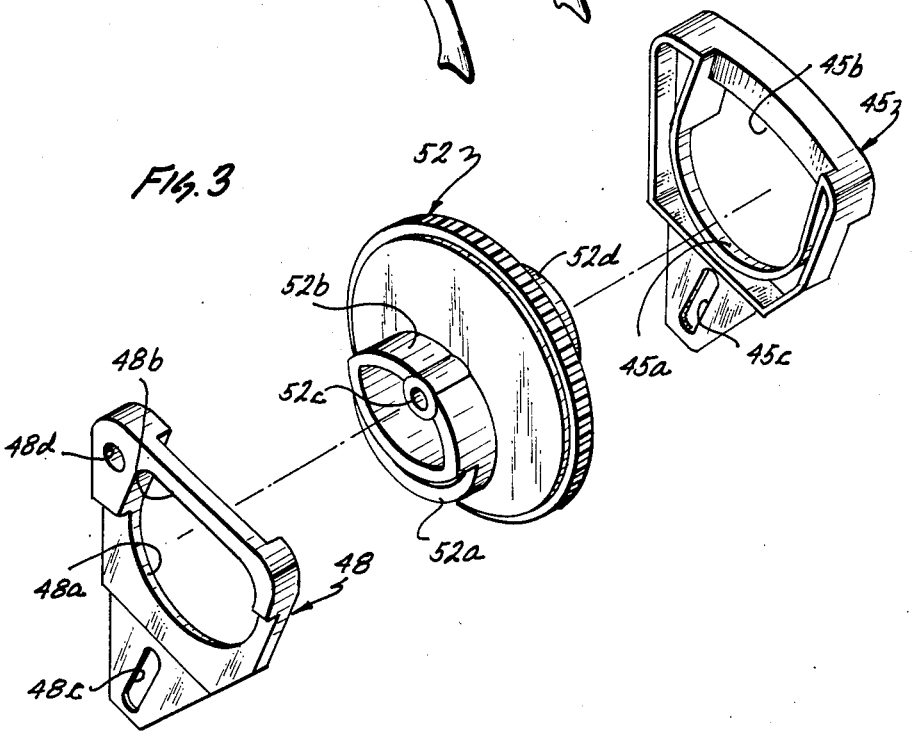
FIG. 3 is an exploded view of the cam member and cam follower members used in the drive mechanism of the toy of FIG. 1.

The primary driving components are illustrated in FIG. 3, which depicts a first cam follower member 45 and a second cam follower member 48 positioned on either side of a double sided cam member 52 which has the circular perpihery thereof provided with gear teeth for driving by the mechanism to be described hereafter. Each side of the cam member is provided with cam means including first and second cam portions **52*a* and 52*b*, the cam portion 52*a* being formed as a protruding circular shoulder with the central aperture 52*c* of the cam member 52 positioned on the circumference of the cam portion 52*a*. The cam portion 52*b* is a shoulder which extends out from the plane of the side of the cam member an additional distance, with cam portion 52b being in the form of an ellipse. The opposite surface of the cam member 52 has identically configured cam portions 52d and 52e, which are angularly displaced from the cam portions 52a and 52b through an angle of approximately 180 degrees, that is, when the circular cam lobe of cam portion 52a on one side is at the top of the cam member 52, the corresponding circular cam lobe of cam portion 52e** on the opposite surface would be at the bottom.

For coaction with these cam portions, each of the cam follower members is identically configured, and by reference to cam follower member 48, an enlarged opening is provided with first and second cam follower edges 48a and 48b for separate coaction with the cam portions 52a and 52b, respectively. The cam follower edge 48a is an arc of a diameter generally equal to the diameter of the circular cam portion 52a, and the configuration of the cam follower member 48 is such that, as assembled, the surface thereof adjacent the edge 48a is in generally sliding abutting relation with the adjacent surface of the cam member 52 with the cam portions thereof extending into the cam follower opening. The second cam follower edge portion 48b is offset outwardly from the side of the cam member 52 for coaction only with the second cam portion 52b. The second cam follower edge portion 48b is an arc of a diameter much greater than the arc diameter of the first cam follower edge portion 48a.

The lower end of the cam follower member 48 is provided with an elongate slot 48c which engages a stationary projection 62 (See FIG. 2) for assisting in controlling the motion of the cam follower member 48, as well as the ultimate motion of the driven leg member 18, as will be described. The length of the slot 48c lies in line with a diameter extending through the circle of the arc 48a. The innermost end of the extension arm 38c of the leg coupling member 38 is received in the socket opening 48d of the cam follower member 48, this socket opening 48d being located adjacent a point of intersection of the two arcs defining the two cam follower portions 48a and 48b.

Referring now primarily to FIG. 2, along with FIGS. 4 and 5, the drive mechanism and the interconnection to the leg members 14–19 will be described. To facilitate assembly, the drive mechanism is contained within a generally hollow housing 60, into which the majority of the various gears and components may be assembled prior to positioning and securing within the body 12. The mechanism is operated by an electric motor 70, the pinion gear of which drives a first cluster gear member 71, which in turn drives a second cluster gear member 72, which in turn drives a third cluster gear member 73, which drives a large diameter idler gear member 74. The cluster gear members 71–73 each include a large diameter outer gear portion and a small diameter pinion gear portion, with the three gears providing gear reduction form the speed of the motor 70 to the speed of rotation of the idler gear member 74.

The idler gear member 74 is in meshing engagement with the toothed periphery of cam members 51 and 52 to simultaneously drive both cam members in the same direction at the same speed. The various directions of rotation of the gears and cams relative to the motor 70 are indicated by arrows thereon. Each of the gears and cam members is rotatably supported within the mechanism housing 60 by suitable axles or shaft members supported between opposing vertical surfaces of the housing 60 in a conventional manner. The third cam member 53 is driven by a small diameter idler gear 75 in meshing engagement with the geared periphery of both cam members 52 and 53, thus driving cam member 53 in the same direction of rotation as the other two cam members 51 and 52, this likewise being indicated by an arrow thereon.

Within the housing 60, each of the cam follower members 47–49 (as well as corresponding cam follower members for the opposite leg members) is supported as shown in FIG. 2, with axle like projections 61–63 extending between opposing vertical surfaces of the housing 60 for passage through slots 47c, 48c and 49c of the cam follower members 47–49, respectively. As will be described, the length of the slots 47c, 48c and 49c coacting with the projections 61–63 serves to limit vertical travel of the cam follower members 47–49 during operation for enabling coaction of the respective cam portion with the respective cam follower edge to define the prescribed path of the extension arm of the respective leg coupling member driven thereby. Although not shown, it is to be understood that the cam follower members associated with the opposite cam portions of the cam members 51–53 will have the slots thereof engaging the same projections 61–63. Correspondingly, when the slot of a cam follower member on one side of the cam is at its uppermost travel relative to the fixed engaging projection 61–63, the slot on the opposite side will be at its lowermost position of travel.

As depicted in FIG. 2, the prescribed paths of movement of the extension arms are illustrated by dotted lines 47', 48' and 49' which correspond to the path of the centers of the socket openings 47d, 48d and 49d of the respective cam follower members 47–49, and it is this path which ultimately determines the action of the leg members 14–19. As previously discussed, the cam portions on opposite sides of a single cam member are mechanically phased to be generally diametrically opposed. Similarly a second mechanical phasing is required, and that is the phase of the cam portions of adjacent cam members relative to each other for driving the a set of legs on one side of the toy 10.

This latter phasing can be seen in FIG. 2, wherein the cam portions 51a and 51b relative to cam member 51 are in general alignment with the corresponding cam portions 53a and 53b of cam member 53, while the intervening cam member 52 has the cam portions 52a and 52b thereof angularly shifted through an angle of approximately 180 degrees relative thereto. As a point of reference with respect to the former phasing of the two sides of the cam members, cam member 51 has thereon a dotted line depiction of the cam portions 51d and 51e on the opposite side thereof to illustrate the generally diametrically opposed relation thereof to the cam portions 51a and 51b.

Additionally, although not shown, it is to be understood that the socket openings of all cam follower members will be positioned rearwardly relative to the housing 60, these socket openings receiving the tips of the extension arms 34c through 39c of the leg coupling members 34–39, respectively, these extension arms 34c–39c passing through openings formed in the opposing sidewalls of housing 60, such as openings 77–79 shown in FIG. 2.

Prior to a detailed description of the operation, by reference to FIG. 5, the cam portions of the cam members 51–53, and the cam follower members have been eliminated to facilitate description, this figure depicting the electrical circuitry as well as the forward to rearward positions of the leg coupling members 34–39. Electrically, the motor 70 is connected in series circuit relation with first and second dry cell batteries 80 and 81 (shown in dotted lines), and in series with a switch 82, which may be a reversing switch enabling forward and reverse direction rotation of the motor 70. The mandible members 20 in the forward portion of the body 12 are pivotally coupled with sector gear portions 20*a* at the ends thereof adjacent the pivot connections with a spring member 21 urging the mandibles 20 toward each other as depicted in solid lines. The mandible members 20 may be manually pivoted to the dotted line positions for engagement with and retention of an object, such as a figure toy (not shown).

In operation of the mechanism, in a horizontal plane as depicted in FIG. 4, the movement or pivoting of the leg coupling members 34–39 about the ball portions 34*a*–39*a* relative to the fixed socket openings 24–29 is illustrated by the solid and dotted line depictions thereof. By reference to FIG. 3, the vertical heights and angular positions of the extension arms 34*c* and 37*c* about the ball portions 34*a* and 37*a* relative to the fixed socket openings 24 and 27 is depicted as viewed from the rear, while in FIG. 2, the side elevational positions of the cam follower members 47–49 are depicted.

By reference to FIG. 2, as the cam members 51–53 rotate in the direction indicated by the arrows thereon, the leg coupling members 37–39 associated therewith, due to the axle projections 34*d*–39*d* and the coacting socket configuration, essentially move or pivot the leg members 14–19 thereof along one axis fore and aft, and along a mutually perpendicular axis, up and down to effect compound motion.

As can be seen in FIG. 2, with cam follower member 47 at its lowest position with slot 47*c* at its lowest position relative to fixed projection 61, cam follower member 49 is in relatively the same position, with the intervening cam follower member 48 at its uppermost position with the lower end of slot 48*c* thereof at its highest position relative to the fixed projection 62 therein.

With cam member 51 rotating counterclockwise as depicted by the arrow thereon, the cam portion 51*a* is in abutting relation with the cam follower edge 47*a* of cam follower member 47. As the cam member 51 continues rotation in the same direction, the cam follower member 47 commences a vertical movement until at some point, it is restrained from rising further due to the coaction of the projection 61 within the slot 47*c*. At this point, the cam portion 51*b* will engage the cam follower edge portion 47*b*, at which point the parts will be in the position exemplified by cam member 52 and cam follower member 48. During this rotation, the inner extreme ends of the engaged extension arms 34*c*–39*c* of the leg coupling members 34–39 will rotate in a modified reclining D-shaped path as depicted by the dotted lines 47', 48' and 49'.

At the point illustrated in FIG. 2, the leg members 14 and 19 associated with cam follower members 47 and 49 will be raised with the leg member 18 associated with cam follower member 48 being lowered and in engagement with the surface on which the toy 10 has been placed. The opposing legs of each pair of legs will be in the opposite position, that is leg members 14, 16 and 18 will be lowered simultaneously, while leg members 15, 17 and 19 will be raised simultaneously. When the generally flattened surfaces of the cam portions 51*b*, 52*b* and 53*b* are in engagement with the cam follower portions 47*b*, 48*b* and 49*b*, this position corresponds to the time of contact of the outer end of the respective leg member with the surface, causing the leg member to remain in contact for a greater duration of time during which forward movement of the toy 10 is accomplished, thus providing a more realistic simulation of the movement of a spider like insect.

With the reclining D-shaped movement of the extension arms 34*c*–39*c* along the dotted line paths 47', 48' and 49' as depicted in FIG. 2, the upper generally horizontal, and longer portion of the cycle thereof corresponds to the time duration in which the outer tips of the respective leg members are in contact with the surface and propelling the toy 10 forward (or in reverse, depending on the switch 82 position). Similarly the lower more curved portion of the path corresponds to the time duration in which the respective leg members are elevated and being pivoted in the forward direction for subsequent contact with the surface. The rearward generally vertical portion of the path corresponds to the time during which the respective leg member is being elevated, and with a generally vertical rise, the elevation of the leg member would be generally vertical. Finally, the forward somewhat sloping portion of the path would correspond to the time during which the respective leg member is being lowered into contact with the surface. The resulting action would be that the leg member is being lowered gradually into contact while being pivoted in a rearward direction (assuming the switch 82 is in the forward direction), this compound motion resulting in realistic simulation of the movement of a spider like insect.

While there has been shown and described a preferred embodiment, it is to be understood that various other adaptations and modifications may be made within the spirit and scope of the invention.

We claim:

1. In an animated toy, the combination comprising:

a body member;

a plurality of leg means pivotably coupled to said body member, each of said leg means having an extension thereof within said body member, said leg means and said body member being configured to provide ball and socket means for allowing pivotal movement of said leg means;

a plurality of cam follower means within said body, each of said cam follower means being in engagement with the end of an extension of one of said leg means and each of said cam follower means having first and second cam follower portions;

a drive mechanism; and a plurality of double sided cam members coupled for rotation by said drive mechanism with each cam on each side having first and second cam portions for coaction with said first and second cam follower portions of an engaging cam follower means for enabling synchronized phased movement of said leg means for enabling propulsion of said toy.

2. The combination according to claim 1 wherein said leg means and said body member are configured for enabling pivoting of said leg means with said leg means in generally depending relation to said body member.

3. The combination according to claim 1 wherein said drive mechanism includes gear and said cam members are gear driven.

4. The combination according to claim 1 wherein there are at least four of said leg means.

5. The combination according to claim 1 wherein said cam members and said cam follower means are configured to provide a reclining generally D-shaped path of pivoting of the engaged end of the extension of said leg means.

6. The combination according to claim 1 wherein said toy is configured in the form of an insect, and there are three pairs of said leg means.

7. The combination according to claim 6 wherein each of said leg means includes a leg coupling member and said leg coupling member and said body member are configured to provide said ball and socket means.

8. The combination according to claim 7 wherein each of said cam members has each side thereof formed to provide a first cam portion in the form of a first shoulder of a generally circular configuration with the circumference of said shoulder on the center of rotation of said cam member, and a second cam portion in the form of a second shoulder extending out from said first shoulder with the periphery thereof generally elliptical.

9. The combination according to claim 8 wherein said cam follower means includes an opening for receiving said cam portions therein, with said first and second cam follower portions formed as offset first and second cam follower edges in said opening to provide coaction between said first cam follower edge and said first shoulder, and coaction between said second cam follower edge and said second shoulder.

10. In an animated toy, the combination comprising:

a generally hollow body member;

a pluraliy of pairs of leg means pivotably coupled to said body member, each of said leg means having an extension thereof within said body member;

a plurality of cam follower means within said body, each of said cam follower means being in engagement with the end of an extension of one of said leg means and each of said cam follower means having an opening with first and second cam follower edges;

a drive mechanism within said body member;

a plurality of double sided members coupled for concurrent rotation by said drive mechanism with each cam on each side having first and second cam portions for selective coaction with said first and second cam follower edges of an engaging cam follower means, the relative positioning of said cam portions on each side of each of said cam members, and the positioning of each of said cam members relative to an adjacent one enabling synchronized phased movement of said leg means for enabling propulsion of said toy, said cam members and said cam follower means being configured to provide a reclining generally D-shaped path of pivoting of the engaged extension of said leg means.

11. The combination according to claim 10 wherein said leg means includes leg coupling members pivotally coupled to said body and leg members attachable to said leg coupling members.

12. The combination according to claim 11 wherein said body member is configured in the form of an insect and there are three pairs of leg coupling members and three pairs of leg members.

13. The combination according to claim 12 wherein said cam members and said cam follower means are configured for enabling two leg members from one side of said body member and one leg member from the other side of said body member to engage a supporting surface generally simultaneously.

14. In an animated toy, the combination comprising:

a body member;

a plurality of leg means pivotably coupled to said body member, each of said leg means having an extension thereof within said body member;

a plurality of cam follower means within said body, each of said cam follower means being in engagement with the end of an extension of one of said leg means and each of said cam follower means having first and second cam follower portions;

a drive mechanism; and a plurality of double sided cam members coupled for rotation by said drive mechanism with each cam on each side having first and second cam portions for coaction with said first and second cam follower portions of an engaging cam follower means for enabling synchronized phased movement of said leg means for enabling propulsion of said toy, said cam members and said cam follower means being configured to provide a reclining generally D-shaped path of pivoting of the engaged end of the extension of said leg means.

15. The combination according to claim 14 wherein said body member is hollow and includes a plurality of integrally formed pivot means for receiving pivotally coacting portions of said leg means.

16. The combination according to claim 15 wherein said integrally formed pivot means includes socket means, and said pivotally coacting portions includes ball means.

* * * * *